US005168131A

United States Patent [19]

Smith et al.

[11] Patent Number: 5,168,131

[45] Date of Patent: Dec. 1, 1992

[54] APPARATUS AND METHOD FOR CONTROLLING AN ELEVATOR

[75] Inventors: Robert P. Smith, Big Bend; John F. Prendergast, Sr., Franklin, both of Wis.

[73] Assignee: The Cheney Company, New Berlin, Wis.

[21] Appl. No.: 589,797

[22] Filed: Sep. 28, 1990

[51] Int. Cl.[5] ..... B66B 1/18

[52] U.S. Cl. ..... 187/127

[58] Field of Search ..... 187/101, 130, 124, 135, 187/126

[56] References Cited

U.S. PATENT DOCUMENTS

| | | | |
|---|---|---|---|
| 4,026,389 | 5/1977 | Magee | 187/126 |
| 4,124,102 | 11/1978 | Doane et al. | 187/29 |
| 4,149,614 | 4/1979 | Mandel et al. | 187/135 |
| 4,400,786 | 8/1983 | Mandel et al. | 187/130 |
| 4,497,391 | 2/1985 | Mendelsohn et al. | 187/29 |
| 4,594,570 | 6/1986 | Tweed, Jr. et al. | 340/21 |
| 4,766,978 | 8/1988 | Blain et al. | 187/101 |
| 5,004,076 | 4/1991 | Chen et al. | 187/130 |
| 5,042,620 | 8/1991 | Yoneda et al. | 187/124 |

*Primary Examiner*—A. D. Pellinen
*Assistant Examiner*—Lawrence E. Colbert
*Attorney, Agent, or Firm*—Michael, Best & Friedrich

[57] ABSTRACT

A control for an elevator system having a single hoistway and a single cab movable by a reversible motor vertically within the hoistway for servicing a plurality of floors. The control includes a call station located at each floor and having a hall call pushbutton, an arrival light and an in-use light, and a plurality of pushbuttons are located in the cab, with one being associated with each floor. A microprocessor is coupled to each of the hall call pushbuttons, in-use lights, arrival lights and cab pushbuttons and is programmed to respond to call signals for actuating a first switching circuit for energizing the motor for movement in a cab raising direction or a second switching circuit for energizing the motor for movement in a cab lowering direction in response to signals from the hall call pushbuttons or cab pushbuttons. The microprocessor is also programmed to determine the location of the cab and the required direction of cab movement, energize the switching circuit means to achieve the desired direction of cab movement and energize the appropriate arrival and in-use lights.

16 Claims, 10 Drawing Sheets

MICROPROCESSOR
U2
CHIME
TO 415
24VDC
24VAC
+24VDC

APPARATUS AND METHOD FOR CONTROLLING AN ELEVATOR

BACKGROUND OF THE INVENTION

This invention relates to elevator controls and more particularly to elevator controls for a single cab system.

Controls for multi-cab, high-rise elevator systems are well-known. However, such controls are not suitable for elevator systems which include a single car and hoistway and which operates between a small number of floors. The latter type of system is mandated by legislation and court decisions which require that residential, small office and manufacturing buildings provide handicapped access.

SUMMARY OF THE INVENTION

It is an object of the invention to provide a new and improved elevator system.

It is another object of the invention to provide a new and improved control for elevator systems having a single cab and hoistway which operate between a limited number of floors.

A further object of the invention is to provide an elevator system having a single cab which is safe and reliable.

These and other objects and advantages of the invention will become more apparent from the detailed description thereof taken with the accompanying drawings.

In general terms, the invention comprises a control for an elevator system having a single hoistway and a single cab movable vertically by a motor within the hoistway for servicing a plurality of floors. A call station is provided at each floor and each call station includes hall call pushbutton means, arrival light means, and in-use light means. A plurality of pushbutton means are also located in the cab with one being associated with each floor. Microprocessor means are coupled to each of the hall call pushbutton means, in-use light means, arrival light means and cab pushbutton means. First switching circuit means is coupled to the microprocessor and to the motor means for energizing the motor for movement in a cab raising direction and second switching circuit means is coupled to the microprocessor and to the motor for energizing the motor means in a cab lowering direction. The microprocessor is also operable to determine the location of the cab and the required direction of cab movement in order to respond to the hall call pushbutton or cab pushbutton request and for energizing one of the first and second switching circuit means for achieving the desired cab movement and for energizing the in-use light means at each floor. The microprocessor means opens the switching circuit means when the cab means reaches a requested floor and energizes the arrival light means at the call station of the requested floor when the cab arrives.

The invention also comprises a method of controlling an elevator system which comprises a single hoistway and a single cab movable vertically within the hoistway by a reversible motor for servicing a plurality of floors and including call station means at each floor and each call station means including hall call pushbutton means, arrival light means, and in-use light means and a plurality of pushbutton means located in the cab and being associated with each floor. The method includes the steps of sensing whether a cab pushbutton or a hall call pushbutton has been pushed, determining if a move to a call station is in progress, determining the location of the cab and the required direction of cab movement in order to respond to the floor pushbutton or cab pushbutton request, energizing the motor for operation in a first direction when cab raising is necessary and energizing the cab for movement in an opposite direction when cab lowering is required, energizing all of the in-use lights when a hall call pushbutton or cab pushbutton is pushed and energizing the arrival light at the requested floor when the cab arrives.

DETAILED DESCRIPTION OF THE PREFERRED EMBODIMENT

Figure 1:
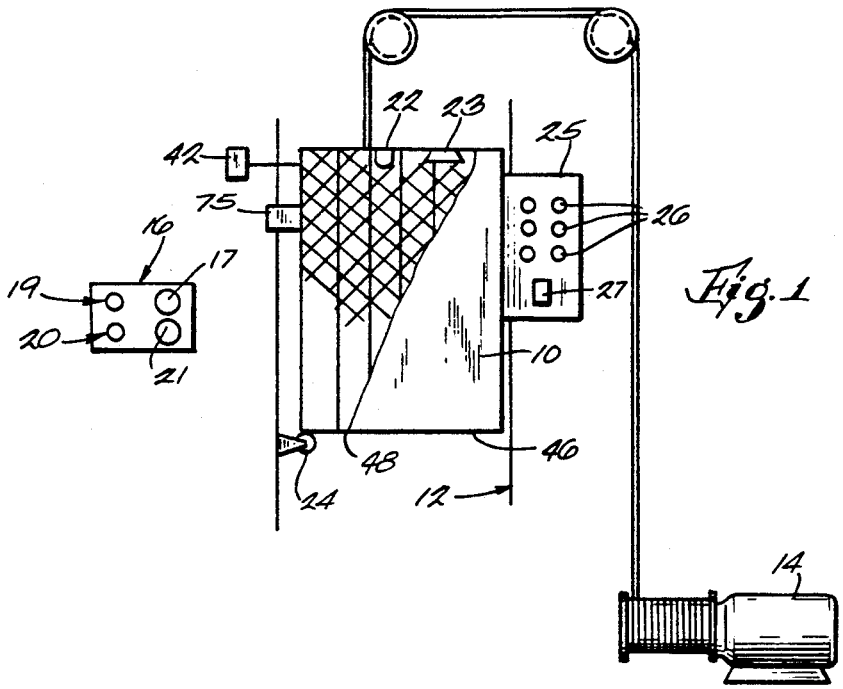
FIG. 1 schematically illustrates an elevator with which the control according to the invention is usable.

The invention is employed with an elevator system of the type schematically illustrated in FIG. 1. This type of elevator system is employed in low-rise buildings such as, about two to six stories, primarily to permit access by handicapped individuals. Such systems typically include a single cab 10 mounted for vertical movement in a hoistway 12 by means of a drive motor 14. At each floor, there is a hall call station 16 which may include a hall call pushbutton 17 for calling the cab 10 and an in-use lamp 19 and a cab arrival lamp 20. In addition, there may be a key switch 21 in series with the call push button 17. It will be understood that there is a hall call station 16 at each floor and that when the hall call pushbutton 17 is pushed, the in-use light 19 at each hall call station 16 will be energized and that the arrival light 20 will be energized when the cab 10 arrives at the particular floor. In addition, the cab 10 may include a dome light 22, a chime 23, and a control panel 25 having a cab pushbutton 26 for each floor and a digital floor indicator 27.

Figure 2:
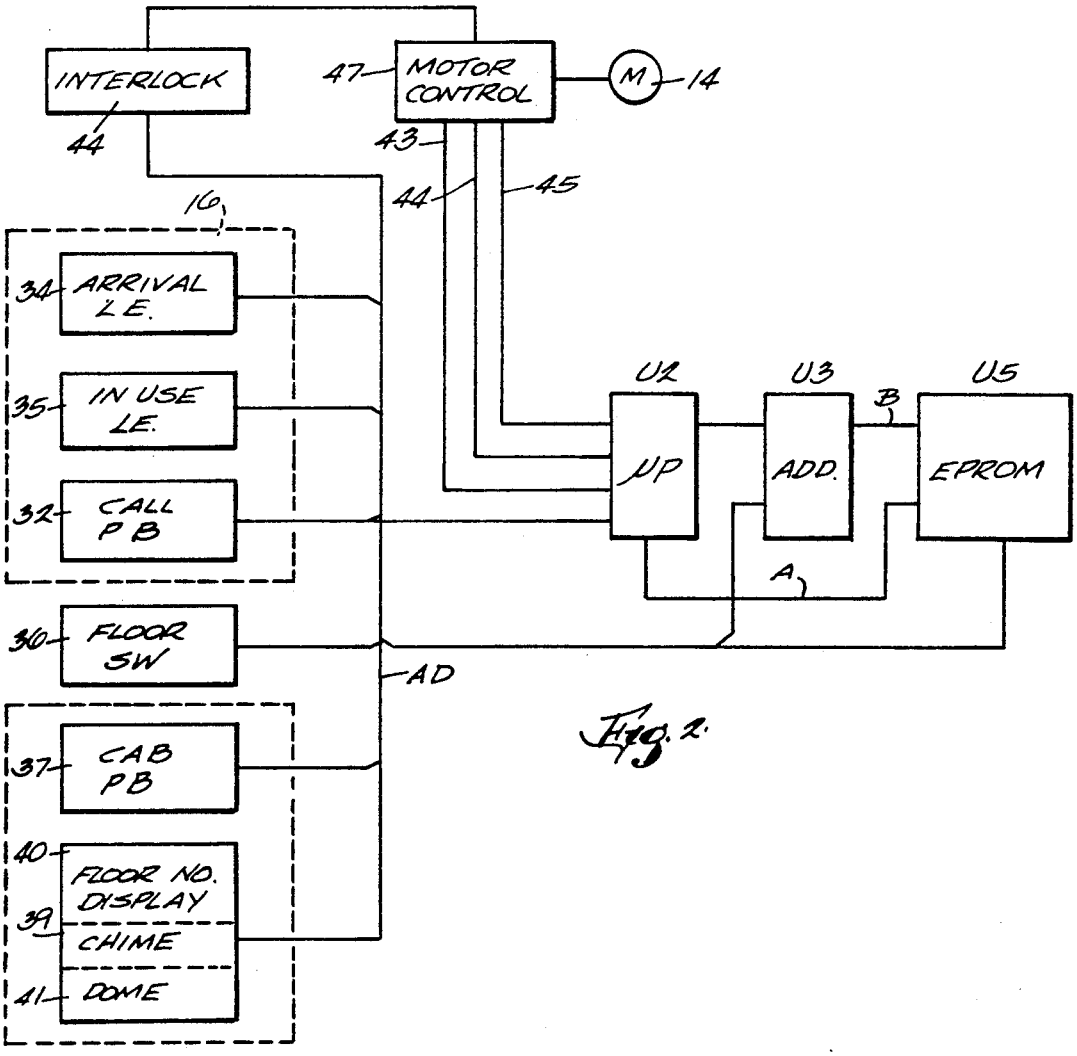
FIG. 2 is a block diagram showing the control in accordance with the preferred embodiment of the invention.

The control system is shown generally in FIG. 2 to include a microprocessor U2 which may include an internal random access memory and a timer. Microprocessor U2 is coupled by a multiplex bus AD to an address latch U3 and an erasable programmable read-only memory, or EPROM, U5. The microprocessor U2 is also coupled to the EPROM U5 by a data bus A and the EPROM U5 is connected to the address latch U3 by bus B.

The microprocessor U2 is also coupled by bus AD to call pushbutton circuits 32, floor switch circuits 36, arrival light circuits 34 and in-use light circuits 35, there being one of each at each of the floors. In addition, the bus AD also connects the microprocessor U2 to the cab pushbutton circuit 37 and a chime relay circuit 39, a floor number display 40 and a dome light circuit 41, all located within the cab 10. Microprocessor U2 provides control signals through conductors 43, 44 and 45 to a motor control 47, which in turn controls the operation of the motor 14. The microprocessor U2 transmits motor control signals to motor control 47 in accordance with a program stored in EPROM U5.

Normally, the cab 10 will be located at the floor at which the last user exited. When another user wishes to use the elevator from a different floor, a hall call pushbutton 17 is pushed, advising the microprocessor U2 through the input data buffer U7 the floor from which the call was made. The program stored in the EPROM U5 will instruct the microprocessor U2 to provide a control signal to the motor control 47 which will cause the motor to operate the cab 10 in the appropriate direction, i.e., up or down. In addition, the microprocessor U2 will energize each of the in-use lights 19. As the cab 10 departs the floor at which it was previously positioned, the floor switch 24 on that floor will close and this information is provided to the microprocessor U2. As the cab 10 reaches its destination, it will energize the arrival lights 20 at the hall station 16 of the appropriate floor, and the floor switch 24 at that floor will be open. The chime 23 and the floor number display 40 will also be actuated. If the passenger opens the floor door 46 and the cab gate 48, the gate interlock switch 42, which forms a part of the interlock system 44, is opened to prevent operation of the motor 14 while the cab gate 48 is open. Opening the cab gate 48 also causes the microprocessor U2 to energize the dome light 22 in cab 10. The passenger may then close the floor door 46 and the cab gate 48 and push one of the cab pushbuttons 26. This will cause the microprocessor U2 to send appropriate up or down signals to the motor control 47 which then causes the motor 14 to move the cab 10 to a new location as requested.

Figure 3:
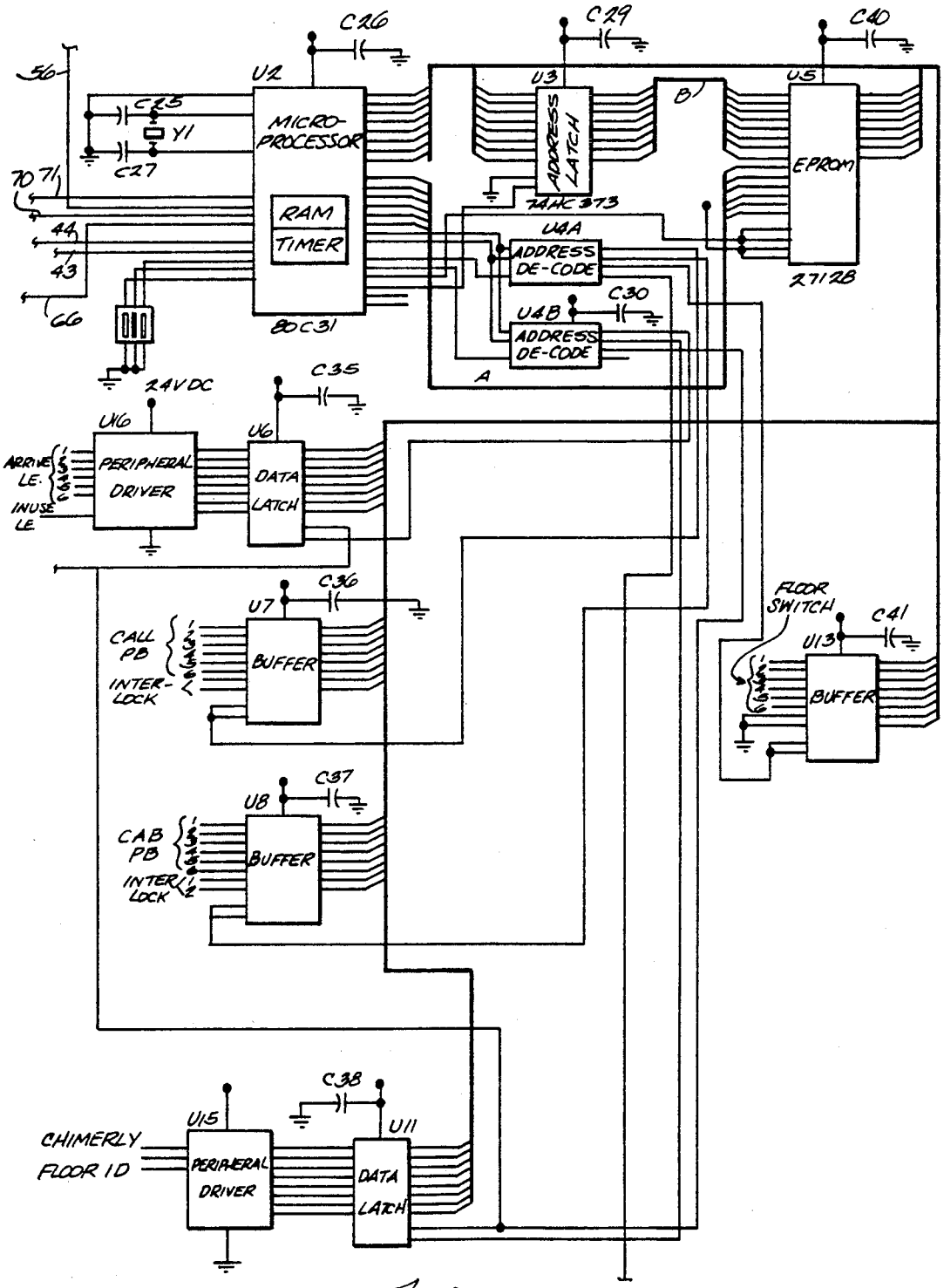
FIG. 3 schematically illustrates in greater detail a portion of the control shown in FIG. 2.

Referring now to FIG. 3, the microprocessor U2 is shown to be coupled to the address latch U3 and the EPROM U5 by multiplex bus AD. In circuit between the bus AD and the call pushbutton circuits 32, the cab pushbutton circuits 37 and the floor switch circuits 36 are buffers U7, U8 and U13, respectively. Signals from the microprocessor U2 to the arrival light circuits 34 and the in-use light circuits 35 are provided through latch circuit U6 and peripheral drive U16 and the microprocessor U2 are coupled to the chime relay circuit 39, the dome light circuit 41 and the floor number display 40 through data latch circuit U11 and peripheral driver U15.

Figure 4:
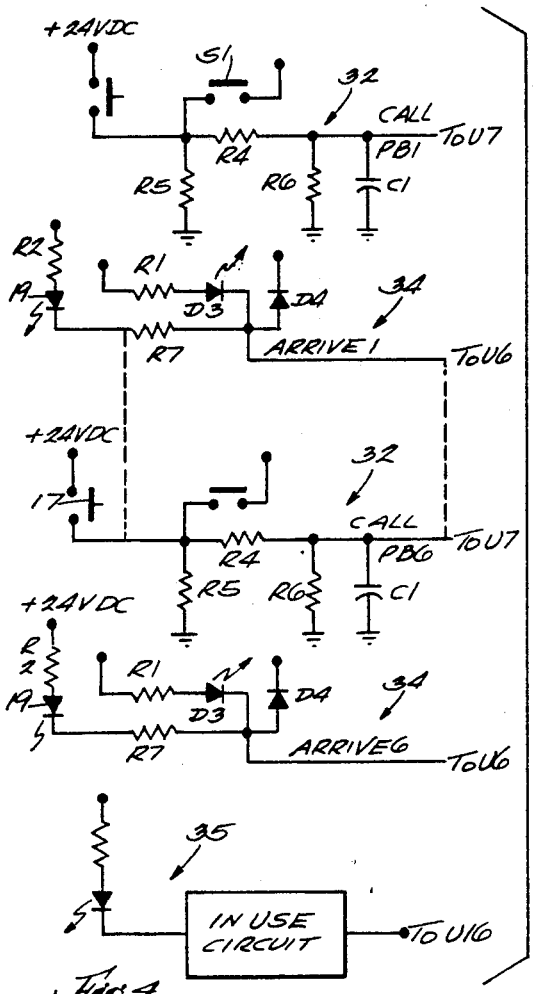
FIGS. 4, 5, 6, 7, 8 and 9 show various portions of the control circuit illustrated in FIG. 2.

A typical call station 16 is shown schematically in FIG. 2 to include a call pushbutton circuit 32, an arrival light circuit 34 and an in-use circuit 35. It will be appreciated that there will be an identical call station 16 on each floor so that in the illustrated example with six floors, there will be six hall call pushbuttons 17, arrival lights 20 and in-use lights 19. The call pushbutton circuit 32 for floor one is shown in FIG. 4 and includes a voltage divider consisting of resistors R4 and R6 and a filter consisting of resistor R4, R6 and a capacitor Cl. The hall call pushbutton 17 is connected between a positive supply voltage and the junction between resistors R4 and R5. The junction between resistors R4 and R6 of each call pushbutton circuit 32 is connected to a different pin of buffer U7. A test switch S1 may also be provided. While only two call pushbutton circuits 32 are shown, it will be appreciated that there will be one at each floor.

The arrival light circuit 34 is also shown in FIG. 4 to include an arrival light in the form of LED 19 having its anode connected through resistor R2 to a positive voltage supply and its cathode connected through resistor R7 to peripheral driver U16. Resistor R1 and LED D3 are provided for test purposes and diode D4 is for circuit protection. The in-use light circuit 35 for each call station 16 may be identical to the arrival light circuit 34 and, accordingly, will not be discussed in detail. It is only necessary to note that there is an in-use light circuit 35 for each floor and all are connected to the same pin of the peripheral driver U16.

Figure 5:
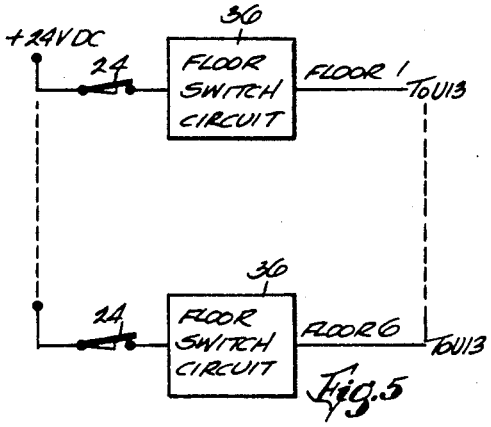

There is a floor switch circuit 36 as shown in FIG. 5 for each floor, although only two are illustrated. Each floor switch 24 is normally closed and is opened when the cab 10 arrives at the floor and recloses when the cab 10 departs. Otherwise, the floor switch circuits 36 are identical to the call pushbutton circuits 32, and accordingly will not be discussed in detail. It should be noted, however, that each of the floor switch circuits 36 are coupled to a different pin of buffer U13. The opening of a floor switch advises the microprocessor U2 of the location of the cab 10, which information is used by microprocessor U2 to determine whether the cab 10 is to be raised or lowered when a call signal is received.

Figure 6:
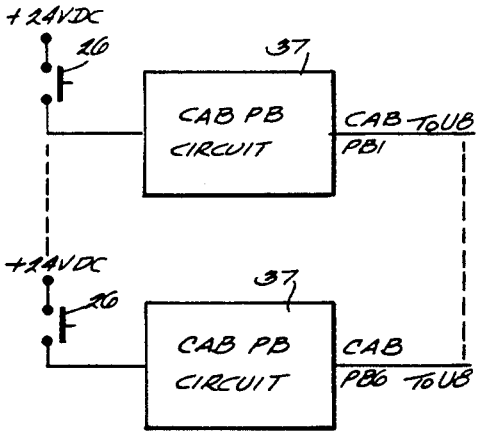

Each of the cab pushbutton circuits 37 are shown in FIG. 6 to include a normally open pushbutton switch 26, but are otherwise identical to the call pushbutton circuits 32 and also will not be discussed in detail. It should be noted, however, that the cab pushbutton circuits 37 are all connected to a different pin of buffer U8.

Microprocessor U2 may be set in either the constant pressure or automatic modes by a dipswitch assembly 50 which, when properly set, provides a binary coded signal to the microprocessor U2. In the constant pressure mode, a hall call pushbutton 17 or a cab pushbutton 26 must be pressed continuously for operation, while in the automatic mode, operation proceeds regardless of whether these pushbuttons are held or released after being pushed.

The floor identification display 40 is conventional and will provide a numeric indication and/or an audible signal in response to a signal from the microprocessor U2 and is connected to peripheral driver U15.

Figures 7, 8:
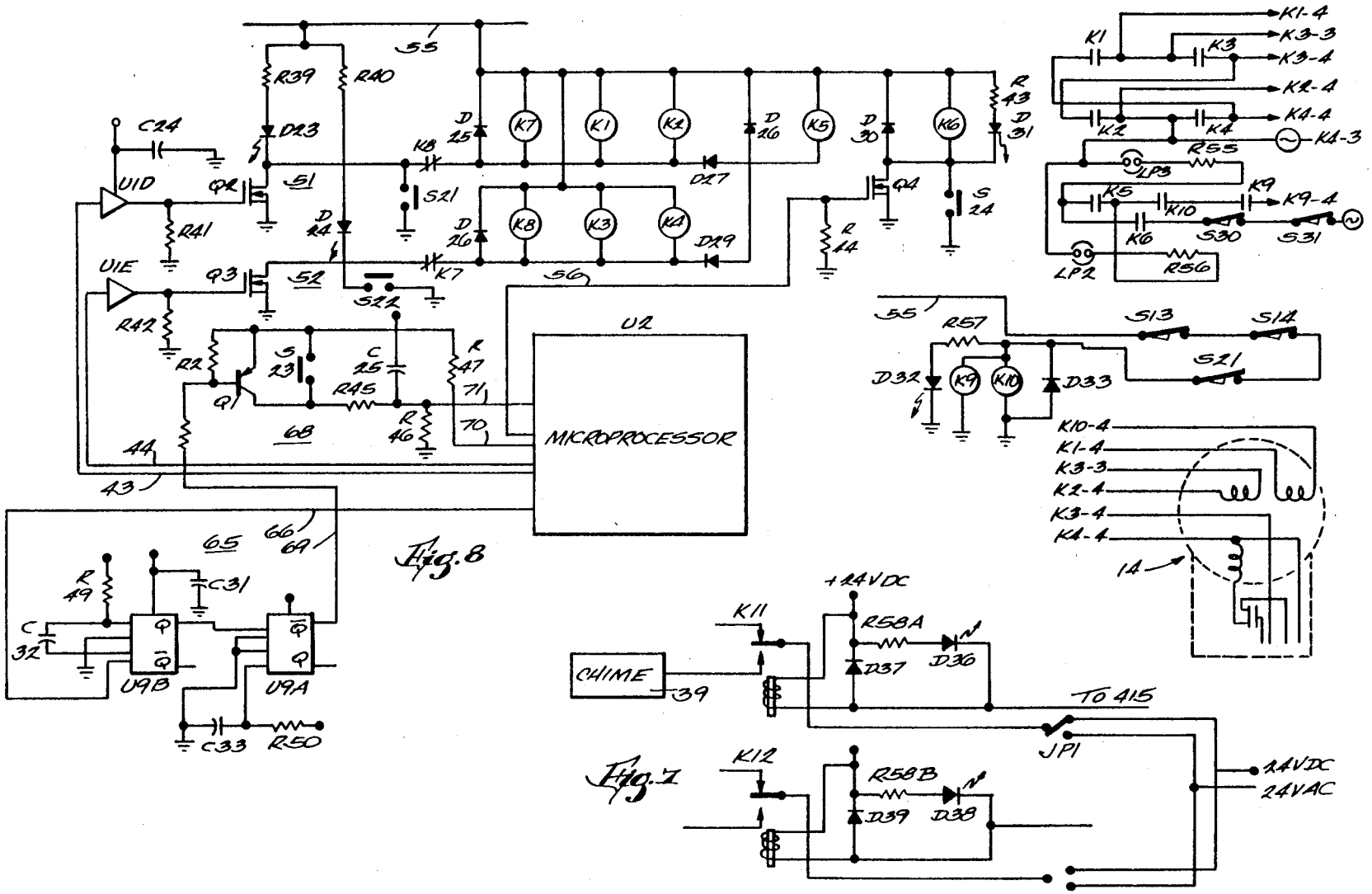
Figure 10A:
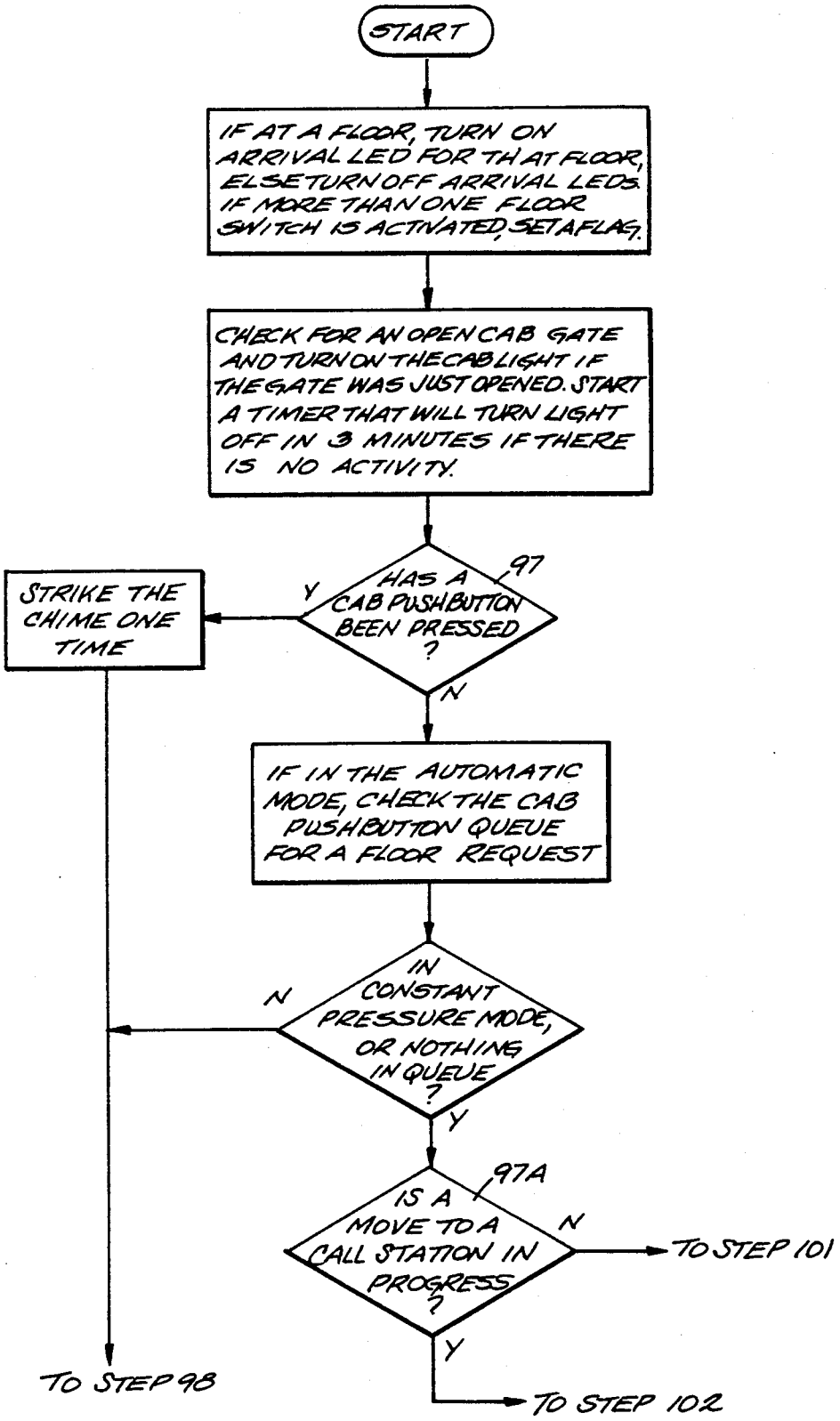
FIGS. 10A, 10B, 10C, 10D, and 10E are flow diagrams illustrating the sequence of commands provided to the microprocessor which forms a part of the control system in accordance with the invention.
Figure 10B:
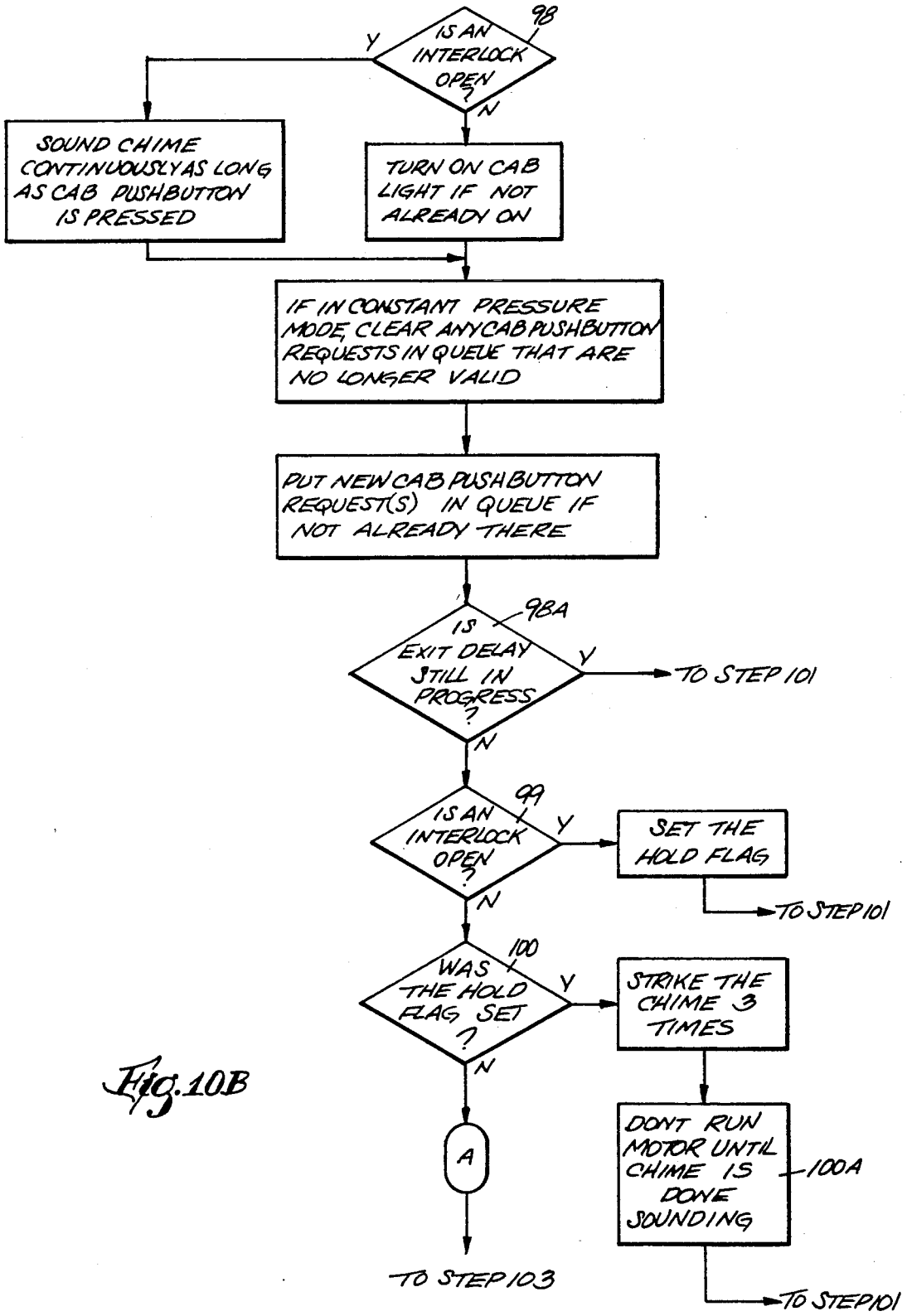
Figure 10C:
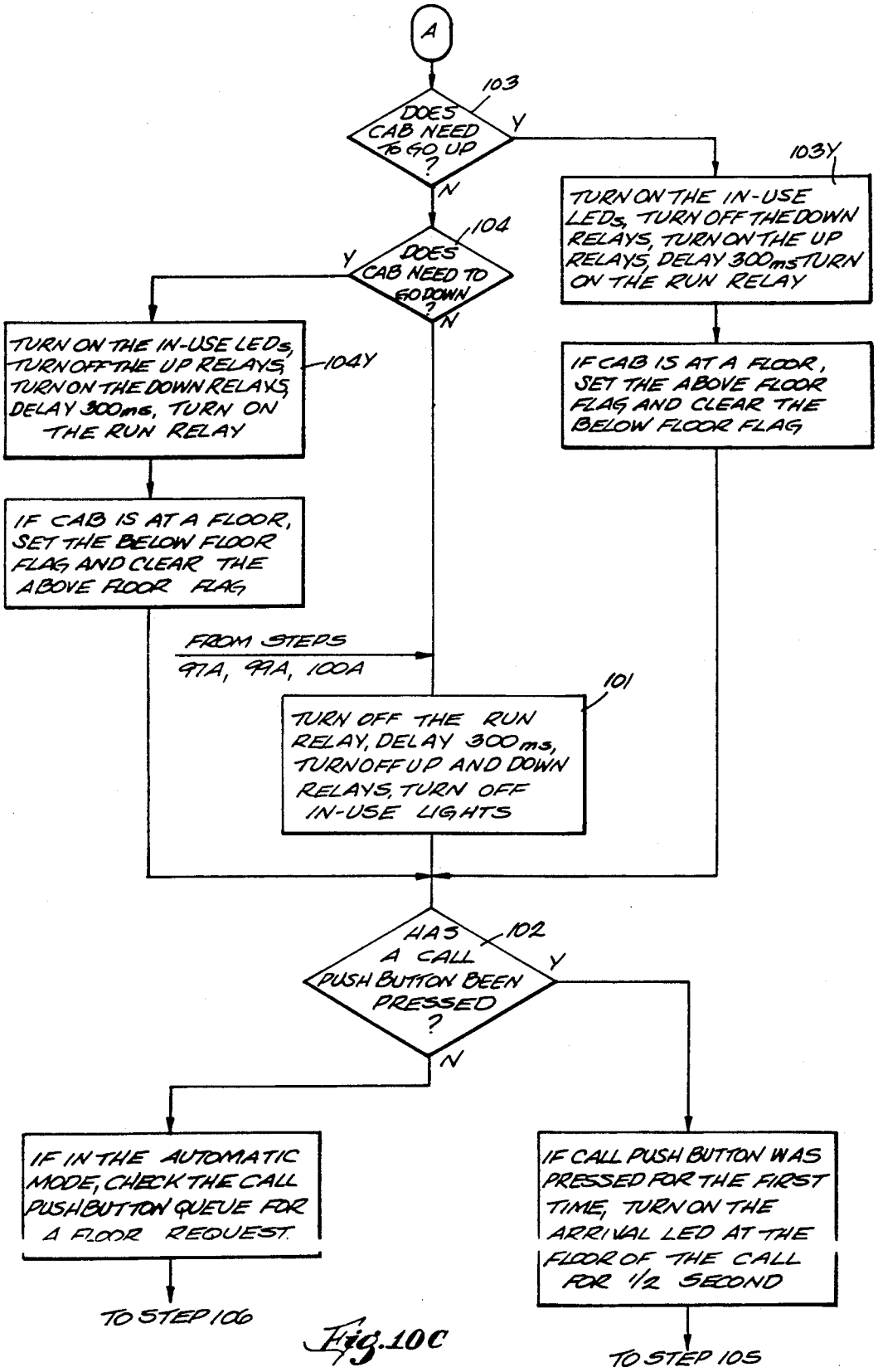
Figure 10D:
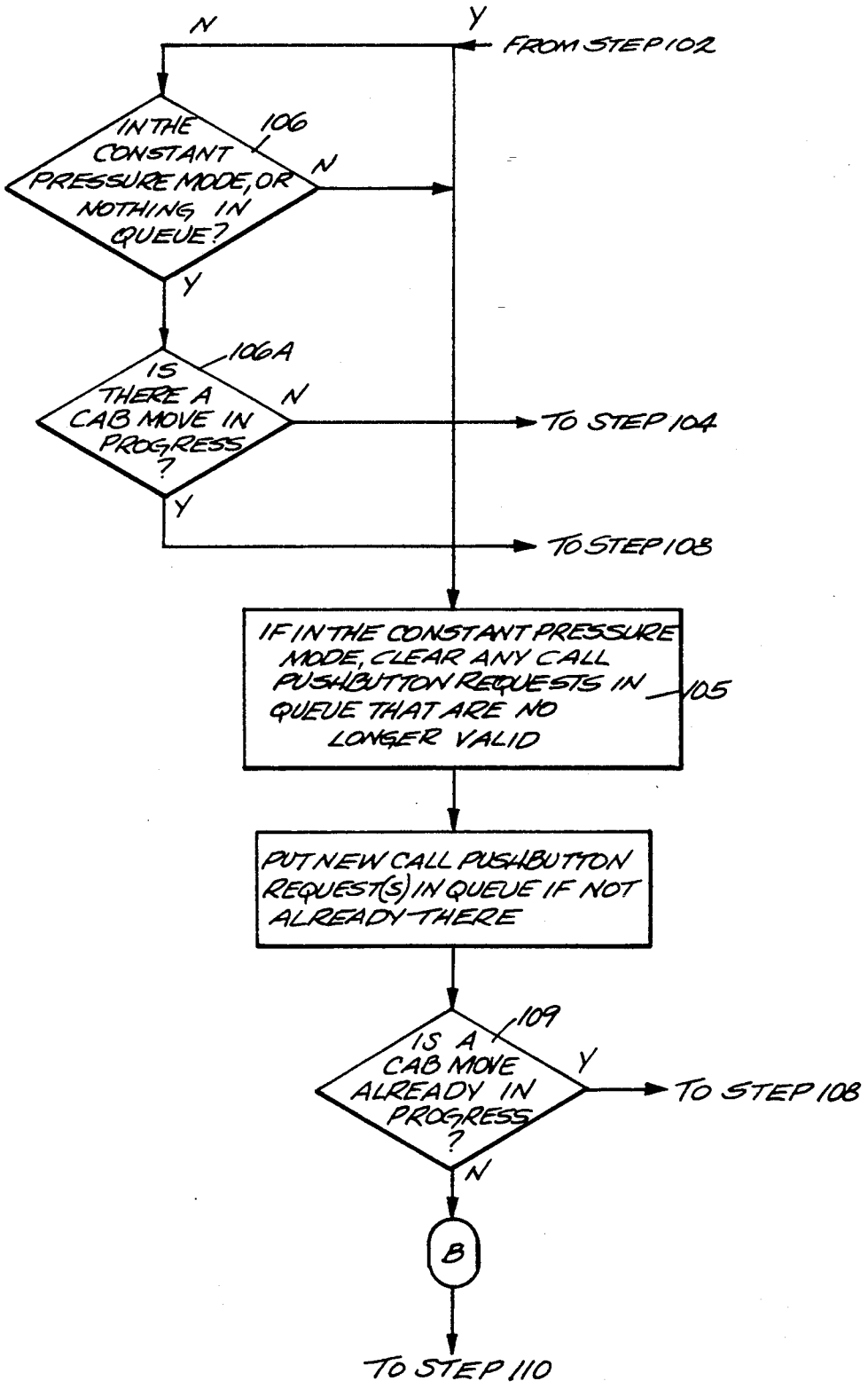
Figure 10E:
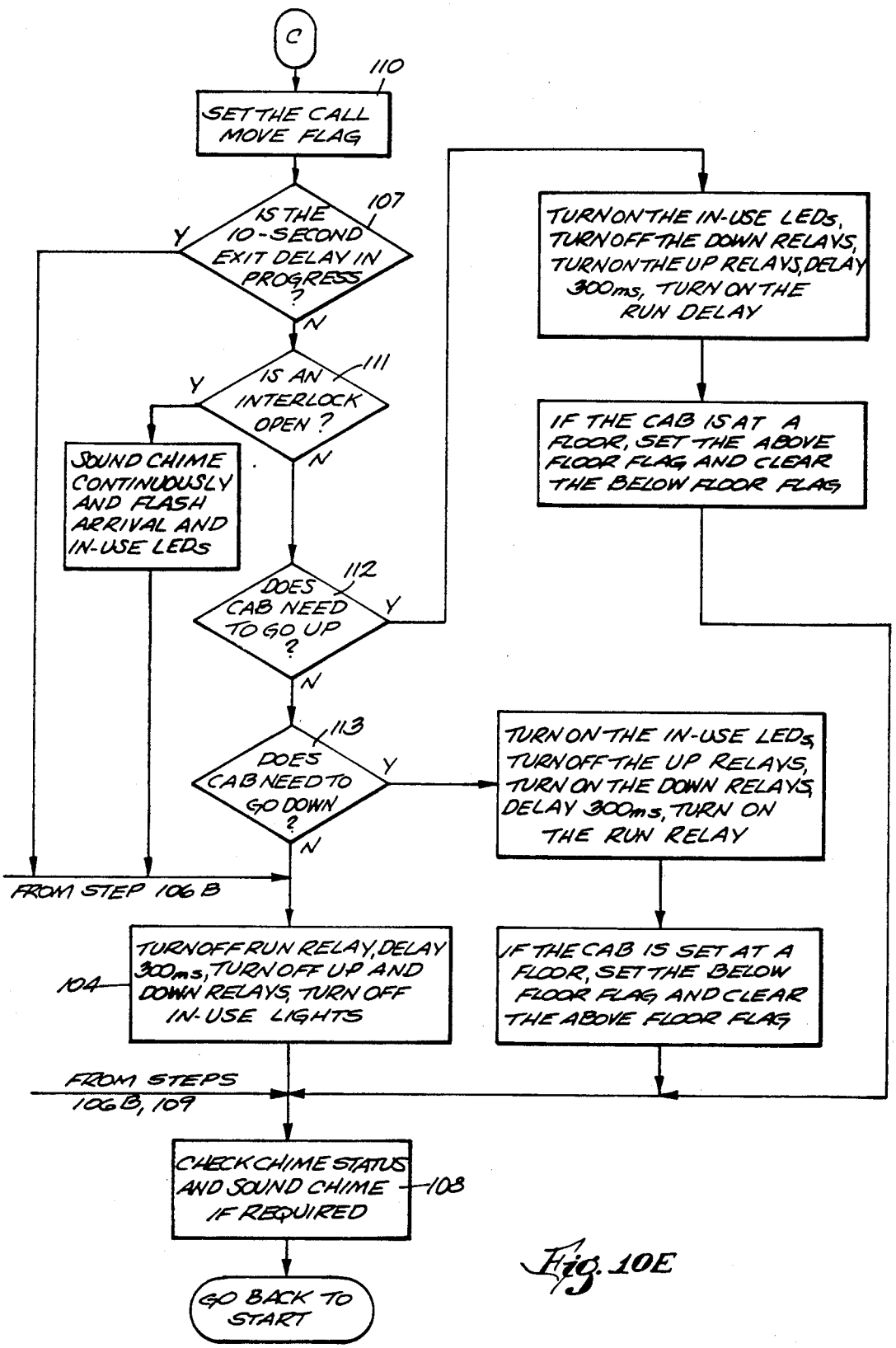

The chime relay circuit 39 is also connected to peripheral driver U15 and is shown in FIG. 7 to include SPDT relay K11, which is operative to connect the chime relay circuit 39 through a switch JP1 to either 24 volts AC or DC. The coil of relay K11 has one end connected to peripheral driver U15 and its other end to the positive DC supply. The series combination of a resistor R58A and an LED D36 are connected in parallel with the coil of relay K11. A spare relay K12 may also be provided as shown.

The motor control 47, shown in FIG. 8, includes identical down and up circuits 51 and 52. The down circuit 51 includes a buffer U1D having an input connected by conductor 43 to the microprocessor U2 and an output connected to the junction of resistor R41 and the base of MOSFET Q2. The drain of MOSFET Q2 is connected through normally closed contacts K8 to one end of parallel connected relay coils K1, K2 and K7. The other ends of these coils are connected to the positive voltage source through interlock return line 55. Diodes D27 and D29 insure the desired direction of current flow. The up circuit 52 is identical to the down circuit 51 and is connected to the microprocessor U2 through conductor 44. Specifically, the up circuit 52 includes relay coils K3, K4 and K8 which are parallel connected to the drain of MOSFET Q3 through normally closed contacts K7. Relay coil K5 is connected in a parallel circuit relation with the down and up relay coils K1, K2 and K3, K4, respectively through diodes D27 and D29. A run relay K6 has one terminal connected to interlock return line 55 and its other terminal connected to ground through the source and drain of MOSFET Q4. The gate of MOSFET Q4 is connected to the microprocessor U2 by conductor 56. Interlock relays K9 and K10 have one terminal connected to ground and their other terminals connected to the interlock return line 55 through a lower final limit switch S13, an upper final limit switch S14 and a pit switch S21, all located in the hoistway 12. These switches are normally closed and open to de-energize relay coils K9 and K10 when the cab 10 moves into its upper and lower travel limits.

Downward movement of cab 10 is initiated when relay coils K1 and K2 are energized to close contacts K1 and K2. After a time delay, 300 milliseconds for example, MOSFET Q4 receives a gate signal from microprocessor U2 to energize relay coil K6 and thereby to close contacts K6 whereby the motor 14 is driven in a down direction. Conversely, when relay coils K3 and K4 are energized to close contacts K3 and K4 and relay K6 is energized after a time delay, the motor 14 is driven in the up direction. Relay K7 is energized simultaneously with relays K1 and K2 to open normally closed contacts K7 and insure that the relays K3 and K4 are not energized when the motor is being driven in the down direction and relay coil K8 is energized simultaneously with relays K3 and K4 to insure that relays K1 and K2 are not energized when the motor 14 is driven in the up direction. Relay coil K5 is energized when the motor 14 is to be run in either the up or down directions. Relay coil K6 is energized when the motor is driven in either the up or down directions and its contacts are connected in series with relay contacts K5, K10, K9 and rotary upper and lower limit switches S30 and S31 between motor terminal K9-4 and the alternating current source 58. Motor operation will be terminated when the motor 14 reaches either of its rotary limits which occurs just beyond the upper and lower final limit positions of cab 10. Initially, relay coil K6 is de-energized to open contacts K6 and then the down relays K1, K2, K7 or the up relays K3, K4, K8 are energized after a time delay, 300 milliseconds, for example. It can be seen that when either the up or down relays K7 or K8 are energized, relay coil K5 will be energized and when neither of the relays K7 or K8 are energized, relay coil K5 will be de-energized to open contacts K5 and thereby insure the termination of motor operation. As a result, should contacts K6 become welded shut, relay K5 will insure that motor operation is terminated. The neon tube LP3 is normally off but is on when relay contacts K6 are closed so that this condition can be indicated when the motor is not running.

A watchdog timer 65 is shown in FIG. 8 to be connected to the microprocessor U2 and includes a first timing circuit U9B connected to the microprocessor U2 through conductor 66 and a second timing circuit U9A is connected by conductor 67 to the first timing circuit U9B and to a reset circuit 68 which, in turn, is connected to the microprocessor U2 by conductors 70 and 71. If the microprocessor U2 is exercising the program in the desired sequence, a series of pulses will be provided from microprocessor U2 to timer U9B through conductor 66 every second or less. As a result, the Q output of timer U9B will be high and the Q terminal of time U9A will be high. If a pulse fails to appear on conductor 66 at least once each second indicating a failure in the program sequence, the Q output of timer U9B will go low and the Q output of timer U9A will go low, thereby turning transistor Q1 on to provide a restart pulse to the microprocessor U2.

Figure 9:
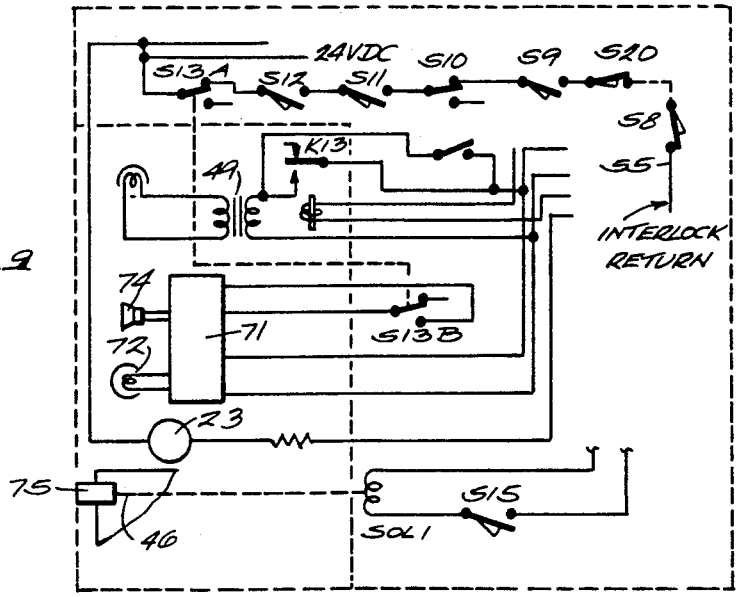

As seen in FIG. 8, the motor control relay coils K1–K8 are connected to the positive voltage source through the interlock return line 55. This line is shown in FIG. 9 to be connected to the positive voltage source through switches S8, S9, S10, S11, S12 and S13. Switch S8 is normally closed and is mechanically coupled to motor output shaft drive belts. If a belt becomes slack or broken, switch S8 will open to terminate motor operation. Switch S9 is a door interlock switch, one of which is disposed at each floor and all of which are connected in series in the interlock loop. Switch S9 is closed when the floor door 46 is closed and opens when the floor door 46 is open. Thus, if the doors 46 at any of the floors are open, the drive motor is prevented from operating. Switch S10 is mounted on the roof of the cab 10 and is provided so that the drive motor can be deactivated during maintenance and servicing. Switch S11 is coupled to the upper center portion of the cab gate 48 and is closed when the cab gate 48 is in its normal position. Should an occupant lean against the cab gate 48, forcing the cab gate 48 outwardly, the switch S11 will open to deactivate the motor. Switch S13, having ganged switches 13A and 13B, is an emergency stop switch which, when operated, not only deactivates the motor 14 but also activates an alarm 74 which is located in the emergency power unit 71.

A door latch solenoid coil SOL1 is located at each floor and each is in series with a second floor switch S15 at each floor and which is closed when the cab 10 is positioned at the floor and which is open when the cab 10 is not present. Solenoid coil SOL1 is energized when switch S15 is closed to operate a door latch 75. When solenoid coil SOL1 is energized, the latch 75 is released and the floor door 46 may be opened and when solenoid coil SOL1 is de-energized, the floor door 46 at each floor is prevented from being opened. This continues unless the cab 10 is present. In addition, normally closed switches S20 at each floor are operated by solenoid coil SOL1 and are in series with the interlock loop. Normally, solenoid coils SOL1 are de-energized and all of the floor doors 46 are latched closed when the motor 14 is operating. When the cab 10 arrives at a floor, floor switch S15 is closed, thereby energizing solenoid coil SOL1 which releases the latch 75 and opens contacts S20. Thus, the floor door 46 can be opened but the motor 14 is prevented from running. When the floor switch S15 is deactivated, coil SOL1 is de-energized, thereby engaging the door latch 75 and reclosing switch S20 so that motor operation can proceed.

The operation of the hardware thus far described will now be discussed. Assume, for example, that the cab 10 is at floor one and that the cab gate 48 and the floor door 46 are closed. The arrival LED 20 at the call station 16 for that floor will be lit. Operation can be initiated either by pushing a hall call pushbutton 17 or opening floor door 46 and cab gate 48. The dome light 22 will be energized if the cab gate 48 has just been opened or if a cab pushbutton 26 is pushed and the dome light 22 is not already on. Assume also, for example, that a passenger on floor three presses the hall call pushbutton 17 and operates the key switch 21. The operation of the hall call pushbutton 17 on floor three will be sensed by the microprocessor U2 through buffer U7. The microprocessor U2 determines the direction required for the cab 10 to move, which in the example is up, so that a gate signal is provided to the MOSFET Q3 which energizes relays K3, K4, K5 and K8. This closes relay contacts K3, K4, and K5 and opens relay contact K8. A gate signal is also sent by the microprocessor U2 to MOSFET Q4 after a 300 millisecond time delay to energize relay coil K6. This also then closes relay contacts K6, assuming that none of the interlock contacts are open. Delaying the energization of relay coil K6 until after contacts K3, K4 and K5 are closed prevents instant motor reversal and insures that these contacts are not called upon to perform a current switching function which would result in more rapid wear. In addition to energizing the motor contacts, the microprocessor U2 also simultaneously actuates the in-use LEDs 19 at all of the floors through data latch U6 and peripheral driver U16. As the cab 10 leaves floor one, the floor switch 24 at floor one opens and this information is provided to the microprocessor U2 through buffer U13.

When the cab 10 arrives at floor three, the floor switch 24 at floor three opens to provide a signal to the microprocessor U2 through buffer U13. The microprocessor U2 then removes the gate signal from MOSFET Q4 to open circuit the relay coil K6, which opens contacts K6 thereby interrupting the flow of power to the motor 14. Three hundred milliseconds thereafter, the microprocessor U2 removes the gate signal from MOSFET Q3, thereby de-energizing relay coils K3, K4 and K8 to open the corresponding contacts. In addition, the microprocessor U2 provides a signal to the arrival LED 20 at floor three, which advises anyone in the hall that the elevator has arrived. Also, a signal is provided to the chime relay 39 through data latch U11 and peripheral driver U15 so that the relay is sounded twice and a signal is provided to the floor digital identification 40 in the cab 10 to indicate floor three. In addition, switch S15 is closed to actuate solenoid coil SOL1, which releases the door latch 75 and permits the passenger to open the floor door 46. This also opens switch S20 in the interlock loop so that the motor cannot run. The cab gate 48 may then be opened, which opens switch S12 in the interlock loop. Finally, the opening of the floor door 46 is sensed by the microprocessor U2 which provides a signal through latch U6 and peripheral driver U16 to the cab light relay K13 (FIG. 9) which energizes the cab dome light 22.

Upon closing the floor door 46 and cab gate 48, the passenger may then push another cab pushbutton 26, causing operation of the elevator to another floor in the manner just described. The in-use LEDs 19 will remain energized only as long as the cab 10 is in motion. When the passenger presses one of the cab pushbuttons 26, this information is provided to the microprocessor U2 through buffer U8. Assume that the passenger presses the cab pushbutton 26 for floor one. This will result in the energization of relay coils K1, K2, K5 and K7 and, after a 300 millisecond time delay, relay K6. When the cab 10 is called to a floor from a hall call station 16, the in-use LED 19 will be energized at all floors and the arrival LED 20 will be lit for a short period, such as one-half second, for example. If the cab 10 is not moved for three minutes after arrival at a floor, a timer in the microprocessor U2 will turn off the cab dome light 22. When the cab 10 arrives at the selected floor, the floor arrival LED 20 will be lit, the chime 23 sounded twice and the motor 14 will be de-energized. In addition, there is a ten-second delay in the software which will prevent movement of the cab 10 to give the passenger time to exit. If the cab gate 48 is not closed after the passenger exits and a hall call pushbutton 17 at another floor is pushed, the arrival LED 20 and the in-use LED 19 at each floor will be energized alternately and the chime 23 will be sounded continuously until the cab gate 48 is closed.

If there are multiple requests, memory in the microprocessor U2 will store these in a queue for controlling the cab 10 so that requests are serviced in the order that they are received. However, service requests received on the cab pushbuttons 26 take precedence over those received from the hall pushbuttons 17.

FIGS. 10A, 10B, 10C, 10D and 10E show the steps that will be executed by the microprocessor U2 in response to instructions contained in the program stored in the EPROM U5. Initially, the cab 10 will be located at a floor and the arrival LED 20 at that floor will be energized and the floor switch 24 will be open, while the remaining floor switches 24 will be closed. However, if more than one floor switch 24 is open, a flag will be set by the microprocessor U2. Operation can be initiated by a passenger opening the cab gate 48, entering the cab 10, reclosing the cab gate 48 and pressing a cab pushbutton 26 for another floor. Alternately, if the passenger and the cab 10 are on different floors, operation can be initiated by pushing a hall call push button 17. The microprocessor U2 checks for an open cab gate interlock switch 42 or 76 and, if none exists, turns on the dome light 22 if the cab gate 48 has been opened and reclosed. The microprocessor U2 also actuates an internal timer which turns off the dome light 22 after a time delay, three minutes, for example, if there is no further activity.

As indicated above, the microprocessor U2 may be set in the constant pressure or automatic modes. In either case, at step 97 the microprocessor U2 determines if a cab pushbutton 26 has been pressed. If the cab pushbutton 26 has not been pressed and if the program is set in the automatic mode, the microprocessor U2 will check the cab pushbutton queue for a floor request. If there is nothing in the queue, the program will proceed directly to step 98. On the other hand, if the program is in the constant pressure mode or if there is a not floor request in the queue, the program will determine whether a move to a call station is in progress. If no such move is in progress, the program will proceed directly to step 101, while if a move to a call station is in progress, the program will move directly to step 102.

If the cab pushbutton 26 has been pressed, at step 97 the chime 23 will be actuated once and the program will proceed directly to step 98 where the microprocessor U2 determines if an interlock is open. If the program determines that there is an open interlock, the chime 23 will be sounded continuously as long as the cab pushbutton 26 is pressed. Regardless of the status of the interlock, or if there is no open interlock, the program will turn on the dome light 22 if it is not already on. In the constant pressure mode, the microprocessor U2 will then clear any cab pushbutton requests in the queue that are no longer valid and then put new cab pushbutton requests in the queue if they are not already there. Next, there will be a check of the exit delay status at step 98A. If the delay is still in progress the program steps directly to step 101. The microprocessor U2 will then determine if there is an open interlock at step 99 and, if not, will determine if the hold flag was set at step 100. If there is an open interlock at step 99, the microprocessor U2 will set a hold flag and proceed directly to step 101. If the program determines at step 100 that the hold flag was set, the chime 23 will be struck three times, the motor 14 will be prevented from operating until the sounding of the chime has been completed and the microprocessor U2 will then proceed directly to step 101. The hold flag is cleared after the last chime.

If there is no hold flag set at step 100, the microprocessor U2 will proceed to step 103 where a determination will be made as to whether the cab 10 must go up and, if not, whether it must go down at step 104. If upward movement of the cab 10 is indicated, at step 103Y the microprocessor U2 will turn on the in-use LEDs 19, open the down relays K1, K2 and K7, turn on the up relays K3, K4 and K8, and energize relay K5. Then, after a time delay, such as 300 milliseconds, for example, run relay K6 will be energized. If the cab 10 is at a floor, the above-floor flag will be set and the below-floor flag will be cleared. Conversely, if downward movement of the cab 10 is indicated, at step 104Y the microprocessor U2 will turn on the in-use LEDs 19, the up relays K3, K4 and K8 will be turned off, the down relays K1, K2, K5 and K7 will be turned on, and the run relay K6 will be turned on after a 300 millisecond time delay. Again, if the cab 10 is at a floor, the below-floor flag will be set and the above-floor flag will be cleared.

If it is not necessary to run the cab 10 up or down, the run relay K6 will be turned off and the up and down relays K1, K2, K3, K4, K5, K7 and K8 will be turned off after a 300 millisecond time delay; the in-use LEDs 19 will be turned off and the program will proceed directly to step 102. At step 102, the microprocessor U2 will determine if a hall call pushbutton 17 has been pressed and, if so, if it has been pressed for the first time, the arrival LED 21 at the floor of the call will be turned on for one-half second and the program will proceed to step 105. If no hall call pushbutton request has been detected at step 102, the microprocessor U2 will check the call pushbutton queue for a floor request if in the automatic mode and then proceed directly to step 106.

At step 106, the microprocessor U2 will determine whether the program is in a constant pressure mode or if there is nothing in the hall call pushbutton queue. If in the automatic mode or there is a floor request in the queue, the program will proceed directly to step 105. On the other hand, if in the constant pressure mode or if there is nothing in the queue, the microprocessor U2 will proceed directly to step 107 if a cab move is not in progress and will proceed directly to step 108 if a cab move is in progress.

At step 105, if the program is in the constant pressure mode, any hall call pushbutton requests in the queue that are no longer valid will be cancelled and then new hall call pushbutton requests will be put in the queue if not already there and the program will proceed directly to step 109. At step 109, the microprocessor U2 will proceed to step 108 if a cab movement is in progress and will proceed directly to step 110 if no cab movement is in progress.

At step 110, the microprocessor U2 will set the call move flag and then proceed to step 107 where it will determine if there is a ten-second delay in progress to permit a passenger to exit the cab 10. The existence of a ten-second delay will move the program directly to step 104. On the other hand, if there is no delay, the microprocessor U2 will determine if there is an open interlock at step 111 which will cause the microprocessor U2 to proceed to step 104 and sound the chime 23 continuously and flash the arrival LEDs 20 and the in-use LEDs 19 continuously. If there is no open interlock, the microprocessor U2 will determine if the cab 10 must be raised at step 112 and, if not, whether the cab 10 must be lowered at step 113. If the cab 10 must be raised or lowered, the procedure discussed above with respect to steps 103Y or 104Y will be repeated, after which the microprocessor U2 will proceed directly to step 108 where the status of the chime 23 will be checked and the chime 23 sounded if required.

Figure 11:
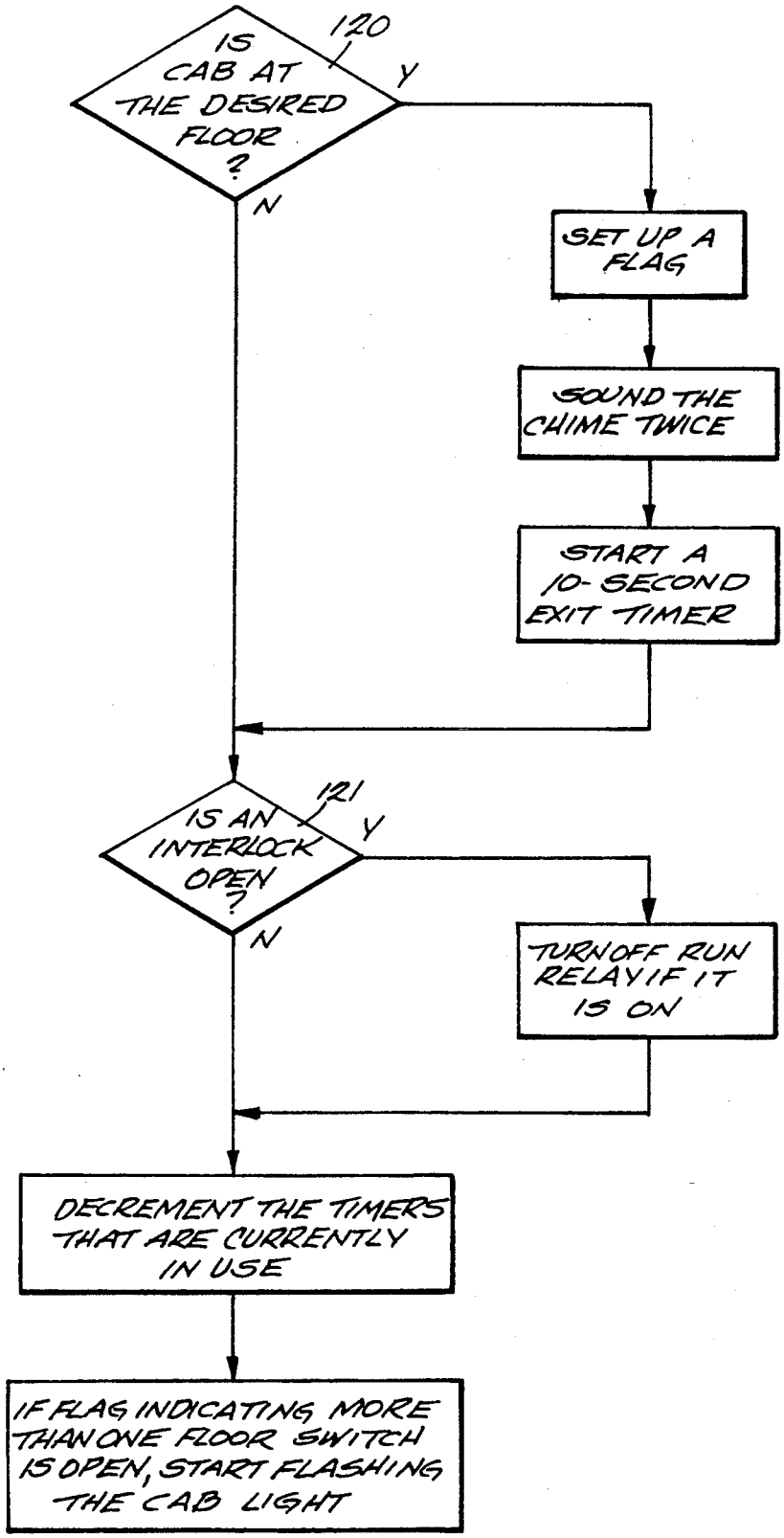
FIG. 11 is a flow diagram illustrating an additional routine of the program which commands the microprocessor of the control system according to the invention.

FIG. 11 shows a real time interrupt routine which is executed by the microprocessor U2 every 50 milliseconds. At step 120, the microprocessor U2 determines if the cab 10 is at a desired floor. If not, the program proceeds to step 121. On the other hand, if the cab 10 is at the desired floor, a stop flag is set, the chime 23 is sounded twice, a ten-second exit timer is begun, and the microprocessor U2 proceeds to step 121. At step 121, the microprocessor U2 determines if an interlock is open and, if so, the run relay K6 will be turned off if it is on. Next, the microprocessor U2 will decrement the timers that are currently in use and if a flag indicates that more than one floor switch is open, the microprocessor U2 will start flashing the dome light 22.

Those skilled in the art will appreciate that there are many conventional circuit components that may be used. However, in the mode practiced, the following components are employed:

| | PART NO. | MANUFACTURER |
|---|---|---|
| Microprocessor U2 | 80C31BH | Intel |
| EPROM | 27128A-20 | Intel |
| Address Decoders U4A, U4B | 74HC139 | Motorola |
| Address Latch U3 | 74HE373 | Motorola |
| Peripheral Drivers U15, etc. | ULN2803A | Sprague |
| Data Latches U6, etc. | 74HC374 | Motorola |
| Buffers U7 etc. | 74HC244 | Motorola |

While only a single embodiment of the invention has been illustrated and described, it is not intended to be limited thereby, but only by the scope of the appended claims.

We claim:

1. A control for an elevator system having a single hoistway and a single cab movable vertically within said hoistway for servicing a plurality of floors, reversible motor means coupled to said cab for moving said cab vertically within said hoistway, call station means at each floor and each call station means including hall call pushbutton means, arrival light means and in-use light means, a plurality of cab pushbutton means located in the cab and one being associated with each floor, microprocessor means coupled to each of said hall call pushbutton means, in-use light means, arrival light means and cab pushbutton means, said hall call push button means and said cab pushbutton means being operative to provide hall request signals and cab request signals, respectively, first switching circuit means coupled to said microprocessor means and to said motor means for energizing said motor for movement in a cab raising direction and second switching circuit means coupled to said microprocessor means and to said motor means for energizing said motor means for movement in a cab lowering direction, said microprocessor means being operable to determine the location of the cab and the required direction of cab movement in order to respond to one of the hall request signals or cab request signals and for actuating one of said first and second switching circuit means for achieving the desired cab movement and for energizing the in-use light means at each floor, said microprocessor means opening said switching circuit means when said cab means reaches the requested floor and energizing the arrival light means at the call station of the requested floor when the cab arrives, said microprocessor including a memory for recording hall request signals and cab request signals and for sequentially activating said motor for moving said cab in response to said hall calls in the sequence in which they are received except that movement of said cab in response to cab request signals is completed preferentially prior to the sequential response to said hall request signals.

2. The control set forth in claim 1 wherein said cab includes a gate movable between open and closed positions to permit entrance into said cab, said hoistway including upper and lower limit switch means, and interlock means coupled to said first and second switching circuit means and to said gate means and to said upper and lower limit switches for preventing the operation of said cab in either a raise or lower direction when the gate is open or the upper and lower limits are exceeded.

3. The control set forth in claim 2 wherein said switching circuit means includes first relay means having a first contacts in circuit for operating the motor in the up direction and second relay means having second contacts for operating the motor in the down direction and third relay means having third contact means in circuit with said motor, said microprocessor being operative to energize said first or second relay means a predetermined time prior to the operation of said third relay means when said motor is de-energized and for de-energizing said third relay means a predetermined time prior to the de-energization of said first or second relay means when said motor means is being de-energized.

4. The control set forth in claim 3 and including audible means in said cab and visible means at said call station, said microprocessor means being coupled to said audible means and said visual means and operable to actuate said audible means when one of the pushbutton means in said cab is pushed, said microprocessor means being operable to actuate said visible means when one of the said call pushbuttons are pushed.

5. The control set forth in claim 1 wherein said microprocessor includes a memory for recording hall calls and cab calls and for sequentially activating said motor for moving said cab in response to said hall calls in sequence except that cab calls are serviced preferentially over hall calls.

6. The control set forth in claim 1 wherein said first switching circuit means includes first relay means having a first contacts in circuit for operating the motor in the up direction and said second switching circuit means includes second relay means having second contacts for operating the motor in the down direction, and third relay means having third contact means in circuit with said motor, said microprocessor being operative to energize said first or second relay means a predetermined time prior to the operation of said third relay means when said motor is de-energized and for de-energizing said third relay means a predetermined time prior to the de-energization of said first or second relay means when said motor means is being de-energized.

7. The control set forth in claim 1 and including audible means in said cab and visible means at said call station, said microprocessor means being coupled to said audible means and said visual means and operable to actuate said audible means when one of the pushbutton means in said cab is pushed, said microprocessor means being operable to actuate said visible means when one of the said call pushbuttons are pushed.

8. A control for an elevator system having a single hoistway and a single cab movable vertically within said hoistway for servicing a plurality of floors, reversible motor means coupled to said cab for moving the same vertically within said hoistway, call station means at each floor and including hall call pushbutton means, a plurality of cab pushbutton means located in the cab and one being associated with each floor, microprocessor means coupled to each of said hall call pushbutton means and cab pushbutton means, first switching circuit means coupled to said microprocessor means and to said motor means for energizing said motor for movement in a cab raising direction and second switching circuit means coupled to said microprocessor means and to said motor means for energizing said motor means for movement in a cab lowering direction, said microprocessor means being operated upon the receipt of a signal from any one of said hall call pushbuttons or cab pushbuttons to determine the location of the cab and the required direction of cab movement in order to respond to the floor pushbutton or cab pushbutton request and for energizing one of said first and second switching circuit means for achieving the desired cab movement, said microprocessor means being operative to deactivate the one of said first and second said switching circuit means when said cab means reaches the requested floor, said first switching circuit means including first relay means having a first contacts in circuit for operating the motor in the up direction and said second switching circuit means comprising second relay means having second contacts for operating the motor in the down direction and third relay means having third contact means in circuit with said motor, said microprocessor being operative to actuate said first or second relay means a predetermined time prior to the operation of said third relay means when said motor is de-energized and for deactuating said third relay means a predetermined time prior to the deactivation of said first or second relay means when said motor means is being de-energized, said microprocessor including a memory for recording hall request signals and cab request signals and for sequentially activating said motor for moving said cab in response to said hall calls in the sequence in which they are received except that movement of said cab in response to cab request signals is completed preferentially prior to the sequential response to said hall request signals.

9. A control for an elevator system having a single hoistway and a single cab movable vertically within said hoistway for servicing a plurality of floors, reversible motor means coupled to said cab for moving the same vertically within said hoistway, call station means at each floor and each call station means including hall call pushbutton means, a plurality of cab pushbutton means located in the cab and one being associated with each floor, microprocessor means coupled to each of said hall call pushbutton means and cab pushbutton means for respectively receiving hall call pushbutton signals and cab pushbutton signals therefrom, first switching circuit means coupled to said microprocessor means and to said motor means for and responsive to said microprocessor means energizing said motor for movement in a cab raising direction and second switching circuit means coupled to said microprocessor means and to said motor means and responsive to said microprocessor means for energizing said motor means for movement in a cab lowering direction, said microprocessor means being programmed for operation upon the receipt of a hall call pushbutton signal from any one of said hall call pushbuttons or a cab pushbutton signal from one of cab pushbuttons to determine whether a hall call pushbutton or cab pushbutton has been pushed, the location of the cab and the required direction of cab movement in order to respond to the hall pushbutton signal or cab pushbutton signal and for actuating one of said first and second switching circuit means for achieving the desired cab movement and for energizing the in-use light means at each floor, said microprocessor means being programmed for deactuating said switching circuit means to deenergize said motor means when said cab means reaches the requested floor, said microprocessor also including a memory for recording hall pushbutton signals and cab pushbutton signals and for sequentially activating said motor for moving said cab in response to said hall pushbutton signals in sequence except that cab pushbutton signals are serviced preferentially over hall pushbutton signals.

10. The control set forth in claim 9 wherein said switching a circuit means includes first relay means having a first contacts in circuit for operating the motor in the up direction and second relay means having second contacts for operating the motor in the down direction and third relay means having third contact means in circuit with said motor, said microprocessor being operative to actuate said first or second relay means a predetermined time prior to the operation of said third relay means when said motor is de-energized and for deactuating said third relay means a predetermined time prior to the deactivation of said first or second relay means when said motor means is being de-energized.

11. The control means set forth in claim 10 wherein said microprocessor has a first mode wherein operation of said motor means is initiated when one of said hall or cab pushbutton is pushed and released and a second mode wherein operation of said motor means is initiated only when said hall or cab pushbuttons are pushed and held, and means for selecting said mode.

12. A method of controlling an elevator system comprising a single hoistway and a single cab movable vertically within the hoistway by a reversible motor for servicing a plurality of floors, call station means at each floor and each call station means including hall call pushbutton means for generating a hall call signal, arrival light means, and in-use light means, a plurality of cab pushbutton means located in the cab with one being associated with each floor and for generating cab call signals, the method includes the steps of sensing whether a cab pushbutton or a hall call pushbutton has been pushed, determining if a move to a call station is in progress, determining the location of the cab and the required direction of cab movement in order to respond to the floor pushbutton or cab pushbutton request, and energizing the motor for operation in a first direction when cab raising is necessary and energizing the motor for movement in an opposite direction when cab lowering is required, energizing all of the in-use lights when a hall call pushbutton or cab pushbutton is pushed and energizing the arrival light at the requested floor when the cab arrives, storing hall pushbutton signals and cab call pushbutton signals, activating said motor in response to cab call signals preferentially over hall call pushbutton signals and sequentially activating said motor for moving said cab in response to said hall call signals in the sequence in which they are received after completion of the responses to all cab call signals in sequence.

13. The method set forth in claim 12 wherein the elevator system includes a cab light and a gate which must be opened to permit access to the cab and interlock means which prevents the operation of the motor when the gate is open, the steps of sensing when said cab gate has been opened and reclosed and energizing said dome light after the closure of said gate and maintaining said dome light being energized for a predetermined time after the last operation of the elevator system.

14. The method set forth in claim 13 wherein said system includes first switch means operative to energizing said motor in a raise direction and second switch means for energizing said motor in a lower direction and third switch means in circuit with said first and second switch means and operative to interrupt current flow to said motor when either of said first and second switch means are closed, the steps of closing one of said first or second switch means in response to a hall call signal and closing said third switch means a predetermined time delay after the closing of said first or second switch means after the cab has moved to its destination, reopening said third switch means and opening of said first or second switch means a predetermined time delay after said third switch means has opened.

15. The method set forth in claim 14 wherein said system includes a microprocessor having a first selectable mode which initiates operation when one of the hall or cab pushbuttons is pushed and released and a second selectable mode which initiates operation only when one of the hall or cab pushbuttons is pushed and held and including the step of selecting one of the modes.

16. The method set forth in claim 15 providing an audible signal in said cab when one of said cab pushbuttons is pushed and providing a visible signal at least one of the call stations where the hall pushbutton thereat is pushed.

* * * * *